US009303435B2

(12) United States Patent
Simmonds et al.

(10) Patent No.: US 9,303,435 B2
(45) Date of Patent: Apr. 5, 2016

(54) GATE LATCH

(71) Applicants: Carl Simmonds, Land O Lakes, FL (US); E. Erik Timothy, Apollo Beach, FL (US); Joseph Ignatius Maria Van Der Plas, Greensborough (AU)

(72) Inventors: Carl Simmonds, Land O Lakes, FL (US); E. Erik Timothy, Apollo Beach, FL (US); Joseph Ignatius Maria Van Der Plas, Greensborough (AU)

(73) Assignee: Nationwide Industries, Inc., Tampa, FL (US)

( * ) Notice: Subject to any disclaimer, the term of this patent is extended or adjusted under 35 U.S.C. 154(b) by 124 days.

(21) Appl. No.: 13/815,261

(22) Filed: Feb. 14, 2013

(65) Prior Publication Data

US 2014/0225383 A1 Aug. 14, 2014

(51) Int. Cl.
*E05C 3/04* (2006.01)
*E05C 1/08* (2006.01)

(52) U.S. Cl.
CPC ..... *E05C 1/08* (2013.01); *Y10T 292/1072* (2015.04); *Y10T 292/11* (2015.04)

(58) Field of Classification Search
USPC ..... 292/238, 251.5
See application file for complete search history.

(56) References Cited

U.S. PATENT DOCUMENTS

| | | | | |
|---|---|---|---|---|
| 6,666,435 | B2 * | 12/2003 | Blosfelds | 256/73 |
| 7,044,511 | B2 * | 5/2006 | Kliefoth et al. | 292/251.5 |
| 7,390,035 | B2 * | 6/2008 | Karcz et al. | 292/163 |
| 8,256,806 | B2 * | 9/2012 | Timothy | 292/251.5 |
| 8,376,421 | B2 * | 2/2013 | Simmonds | 292/251.5 |
| 8,505,989 | B2 * | 8/2013 | Wells | 292/251.5 |
| 8,525,686 | B2 * | 9/2013 | Burdenko | 340/665 |
| 2011/0148126 | A1 * | 6/2011 | Macernis | 292/251.5 |
| 2011/0193354 | A1 * | 8/2011 | Simmonds | 292/251.5 |

* cited by examiner

*Primary Examiner* — Mark Williams

(57) ABSTRACT

A gate latch device to secure a gate in a closed or latched position to a fence or other barrier to close or block a portal formed therein comprising a latch assembly including a lower latch pin and a keeper safety catch mounted to the fence or other barrier adjacent the portal and a keeper assembly including a magnet disposed adjacent a latch pin recess mounted to the gate such that when the gate is closed the magnet attracts the lower latch pin from a normally biased upper or unlatched position to a lower or latched position drawing the lower latch pin downward into the latch pin recess against the force of the bias to prevent the gate from opening and wherein the keeper safety catch selectively engages the keeper assembly to limit the outward movement of the keeper assembly relative to the latch assembly to retain the lower latch pin from becoming dislodged from the latch pin recess to maintain the gate in the latched position.

17 Claims, 7 Drawing Sheets

GATE LATCH

CROSS-REFERENCE

This is a continuation-in-part application of application Ser. No. 12/658,534 filed Feb. 8, 2010 now U.S. Pat. No. 8,376,421 B2 issued on Feb. 19, 2013.

BACKGROUND OF THE INVENTION

1. Field of the Invention

A gate latch device to secure a gate in a latched or closed position to block an opening in a fence or other barrier.

2. Description of the Prior Art

Numerous devices and systems have been developed to secure an area from unauthorized or dangerous entry particularly to prevent young children from entering a pool area without supervision including safety pool fences. Such safety pool fences usually include a self-latching device designed to operate automatically on closing the gate of the fence. These self-latching devices are designed to prevent the gate from being reopened without manual releasing of the mechanism.

U.S. 2011/0193354 describes a magnetic gate latch device to secure a gate in a locked position to a fence or other barrier to close or block a portal formed therein comprising a latch assembly including a lower latch pin normally biased in upper or unlocked position coupled to an upper latch pin actuator mounted to the fence or other barrier adjacent the portal and a keeper assembly including a keeper base affixed to the gate having a latch pin recess formed therein having a magnet disposed adjacent the latch pin recess such that when the gate is closed the magnet moves the lower latch pin and upper latch pin from the normally biased upper or unlocked position to a lower or locked position drawing the latch pin into the latch pin recess against the force of the bias and when the upper latch pin actuator is moved upwardly the lower latch pin is moved upwardly withdrawing the lower latch pin from the latch pin recess to permit the gate to be opened as the bias maintains the lower latch pin in upper or unlocked position.

U.S. Pat. No. 7,963,575 relates to a gate latch assembly comprising a biased latchbolt movable between a retracted position and an extended position and a latchbolt catch to selectively receive the latchbolt. A two-stage mechanism for repositioning the latchbolt from the extended position to the retracted position, including a first stage mechanism having a clutch to selectively engage the latchbolt and a second stage mechanism for repositioning the latchbolt from the extended position to the retracted position while the clutch is engaged where the second stage mechanism is repositionable independent of the latchbolt when the clutch is not engaged.

U.S. 2011/0148126 discloses a latch for securing a gate closed comprising a bar assembly disposed on the gate. The bar assembly comprises a bar member which is attractable by a magnet. An engagement assembly is disposed on the fence to engage the bar member. An elongate member movable between an attraction position in which attraction between a magnet and the bar member causes movement of the bar member into engagement with an engagement assembly when the gate is closed and a release position in which attraction between the magnet and the bar member is reduced, enabling disengagement of the bar member from the engagement assembly.

U.S. Pat. No. 5,362,116 shows a self latching device to latch in two members which are otherwise movable relative to each other for use with a gate. The device comprises a latch arm mounted to one of the members movable between a latched position and a retracted position, and a retaining element with a permanent magnet mounted to the other member. The latch arm is normally spring biased in the retracted position but is moved by the magnetic field generated by the magnet to the latched position to secure the gate in a closed position.

U.S. Pat. No. 5,664,769 teaches a gate assembly for tensioned fences such as used to enclose the perimeter of home swimming pools. The gate in a preferred form is "U" shaped with no rigid bar at the top has the space between the bars of the gate filled with tensioned mesh fabric similar to the tensioned fence. The gate is supported by poles on each edge which provides spring closed hinging on one edge and an automatic latch at the opposite edge. The poles are pairs of poles at each side which together react to the tension of the fence without transferring the fence tension to the gate.

U.S. Pat. No. 7,044,511 relates to a magnetic latch system including a latch assembly and a keeper assembly. The keeper assembly includes a magnetically attractable keeper pin. The latch assembly includes a magnet and a movable internal lever to engage the keeper pin to move it away from the permanent magnet. The system may also include a lock to hold the internal lever in a fixed position so that it cannot be moved to move the keeper pin away from the magnet.

U.S. Pat. No. 7,100,405 shows a latching device for swimming pool gates including an automatic magnetic latch with a child resistant device to control access to the pool area. The child resistant device may include an operating handle at an elevated location to be out of the reach of the child and an alternative operating device is provided at a lower location with child resistance provided typically by a push button arrangement acting through a cam and cam follower to raise a latching arm against the biasing to the latching position.

Additional examples of the prior art are found in U.S. Pat. No. 3,350,127; U.S. Pat. No. 5,114,195; U.S. Pat. No. 5,469,805; U.S. Pat. No. 5,490,698; U.S. Pat. No. 5,823,026; U.S. Pat. No. 6,155,616; U.S. Pat. No. 6,666,435; U.S. Pat. No. 7,390,035 and U.S. Pat. No. 7,954,445.

SUMMARY OF THE INVENTION

The present invention relates to a gate latch device comprising a latch assembly mounted to a fence post adjacent an opening or portal in a fence or other barrier and a keeper assembly attached to a gate movable between an unlatched or open position and a latched or closed position to close or block the opening or portal when the gate is in the latched or closed position.

The latch assembly comprises an upper latch pin actuator coupled to a lower latch assembly and a keeper safety catch.

The upper latch pin actuator comprises an upper actuator pull knob or member and an elongated latch pin actuator bar or member; while, the lower latch assembly comprises a lower latch pin or member coupled to the lower portion of the elongated latch pin actuator bar or member and a bias disposed in surrounding relationship relative to the lower latch pin or member to normally bias the lower latch pin or member in the upper or unlocked position.

The keeper safety catch comprises an upwardly projecting stop to selectively engage the keeper assembly to prevent the lower latch pin or member from becoming dislodged from the keeper assembly when the gate is in the latched or closed position to prevent the gate from moving to the unlatched or open position.

The keeper assembly comprises a keeper base attached to the gate having a keeper arm extending outwardly therefrom. The keeper arm comprises a latch pin receptacle or recess formed therein to receive the lower latch pin or member when in a lower or locked position and a magnet recess to retain a magnet adjacent to the latch pin recess disposed to attract and move the lower latch pin or member into the latch pin receptacle or recess when the gate is moved to the closed position.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
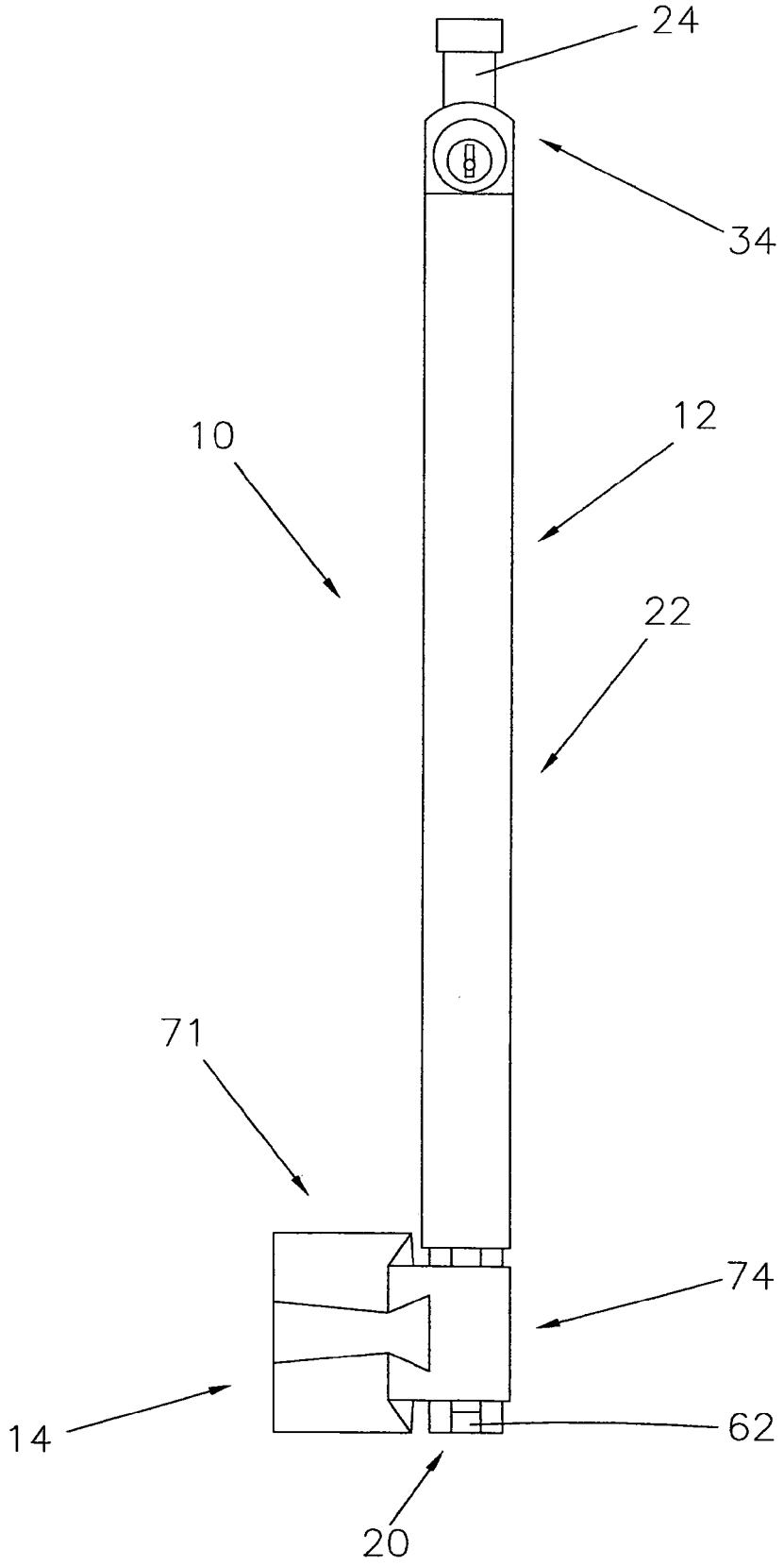
FIG. 1 is a front view of the gate latch device of the present invention.
Figure 2:
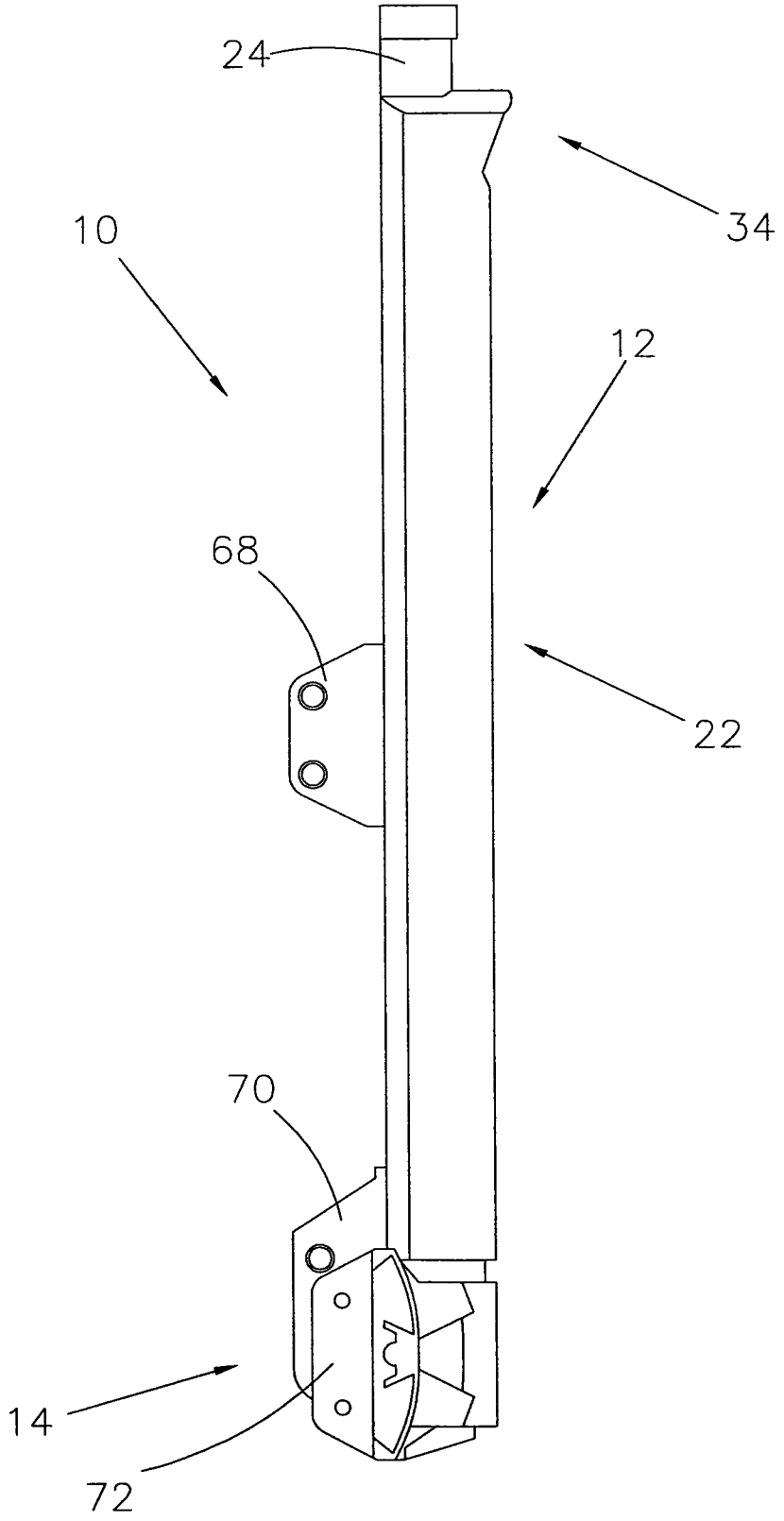
FIG. 2 is a side view of the gate latch device of the present invention.
Figure 3:
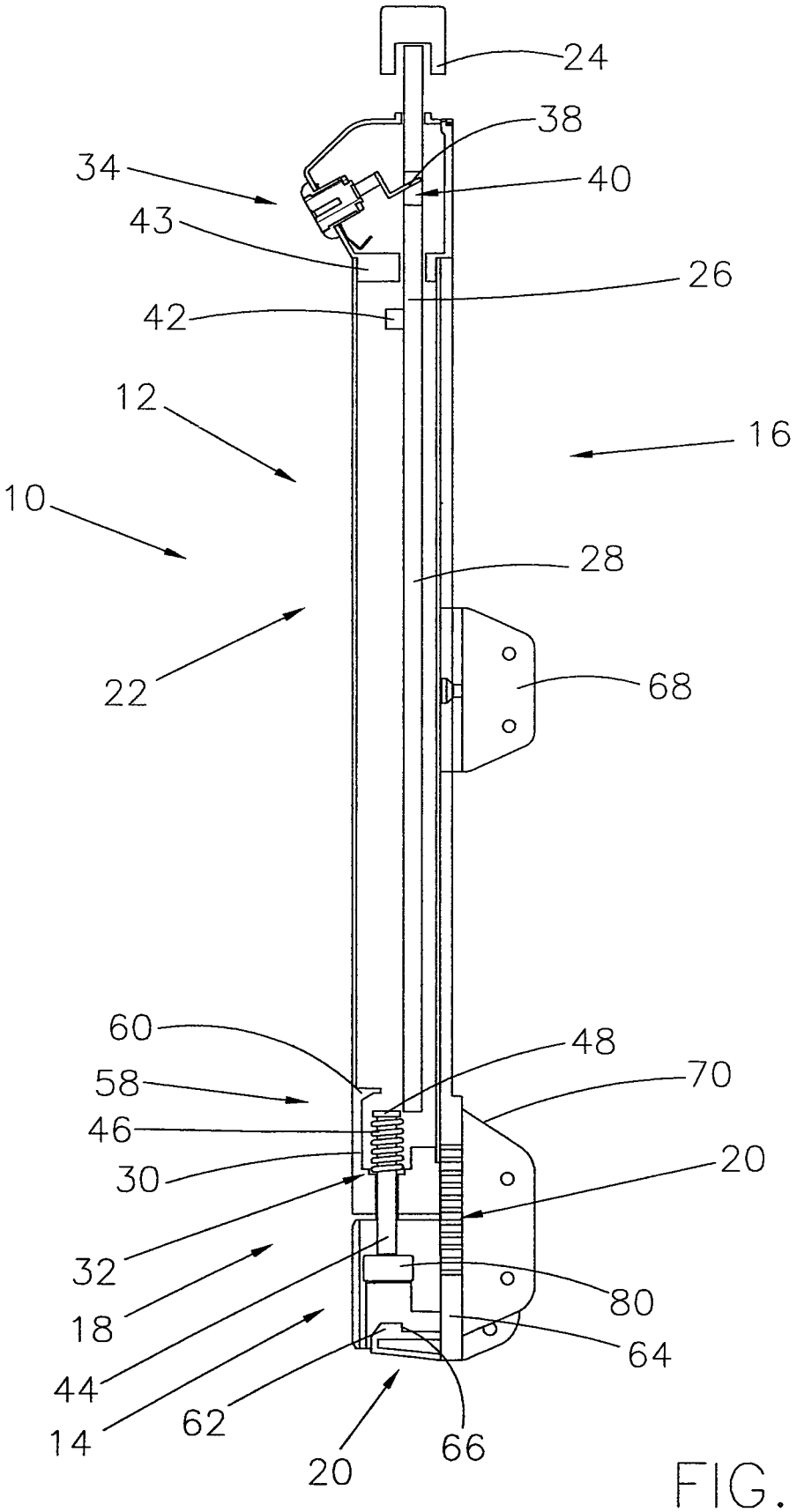
FIG. 3 is a cross-sectional side view of the gate latch device of the present invention.

As shown in FIGS. 1 through 3, the present invention relates to a gate latch device generally indicated as 10 comprising a latch assembly generally indicated as 12 mounted to a fence post (not shown) adjacent an opening or portal in a fence or other barrier (not shown) and a keeper assembly generally indicated as 14 attached to a gate (not shown) movable between an unlatched or open position and a latched or closed position to close or block the opening or portal (not shown) when the gate (not shown) is in the closed position.

Figure 7:
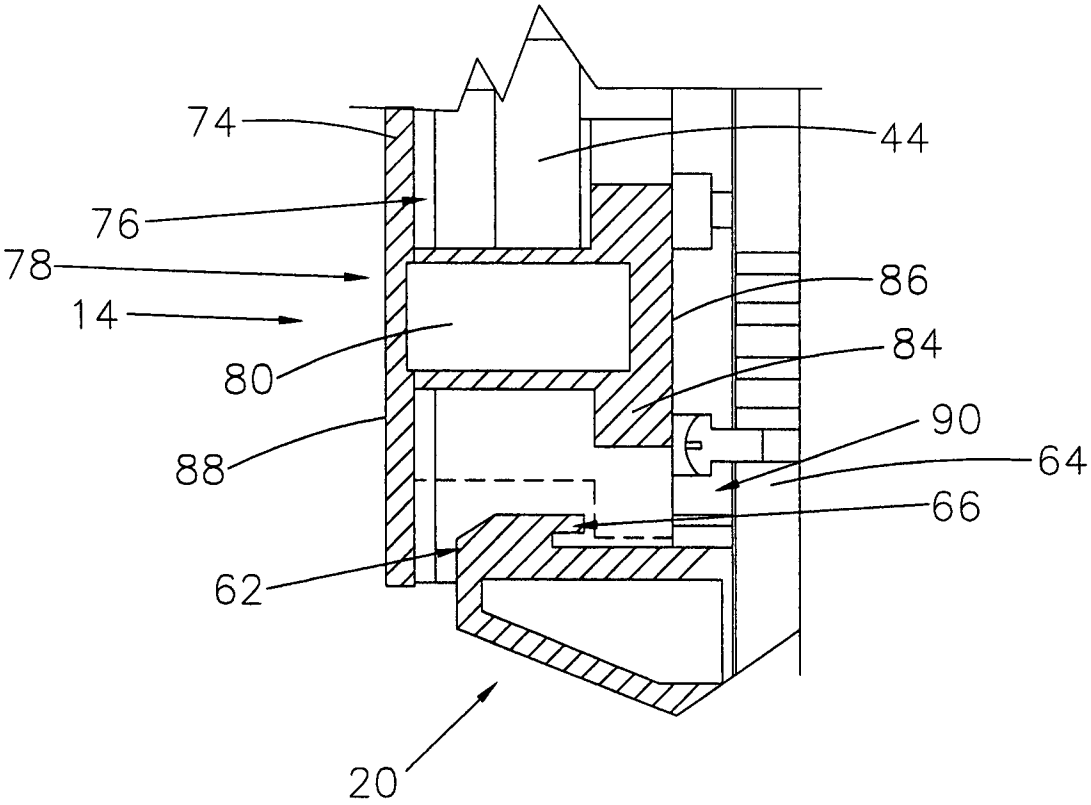
FIG. 7 is a partial cross-section side view of the latch pin assembly and the keeper assembly of the gate latch device of the present invention.

As shown in FIGS. 3 and 7, the latch assembly 12 comprises an upper latch pin actuator assembly generally indicated as 16 coupled to a lower latch pin assembly generally indicated as 18 and keeper safety catch generally indicated as 20.

As shown in FIGS. 1 through 3, the upper latch pin actuator assembly 16, the lower latch pin assembly 18 and the keeper safety catch 20 are at least partially disposed in the latch housing generally indicated as 22.

Figure 5:
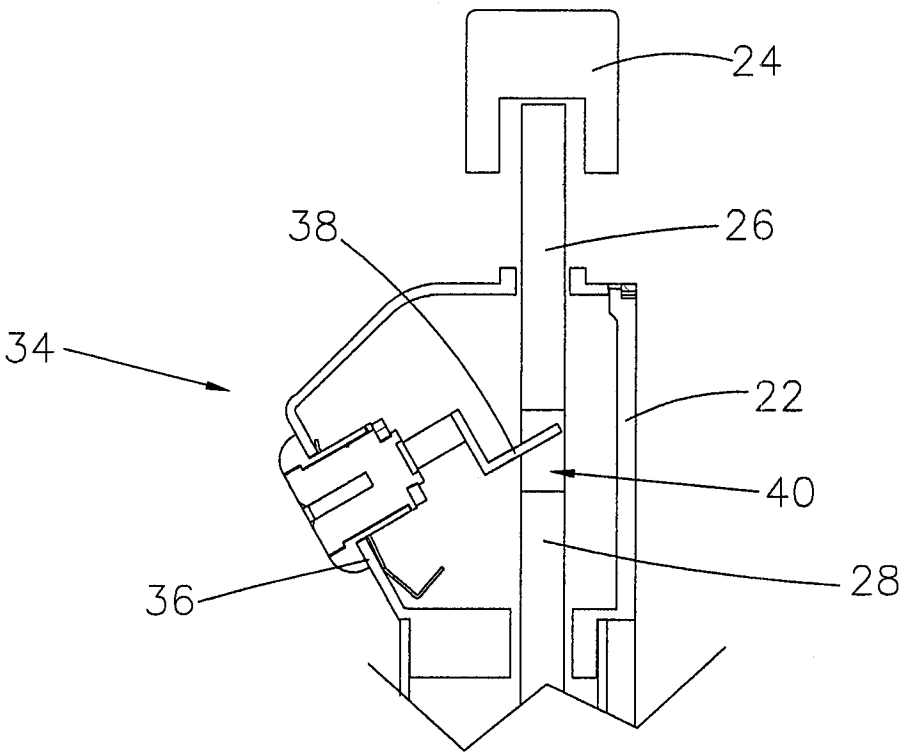
FIG. 5 is a cross-section side view of the lock assembly of the gate latch device of the present invention.

As shown in FIGS. 3 and 5, the upper latch pin actuator assembly 16 comprises an upper actuator pull knob or member 24 coupled or attached to the upper portion 26 of a substantially ridged elongated latch pin actuator bar or member 28 having a lower latch pin support 30 having a latch pin aperture 32 formed therethrough formed on the lower portion thereof to couple the upper latch pin actuator assembly 16 and the lower latch pin assembly 18 together.

As shown in FIGS. 3 and 5, a lock assembly generally indicated as 34 comprises a rotatable cylinder lock 36 including a lock member'38 moveable between a first or unlocked position and a second or locked position operatively coupled to or mounted on the latch housing 22 and a lock notch or recess 40 formed on the upper portion 26 of the substantially ridged elongated latch pin actuator bar or member 28 to selectively receive the lock member 38 when in the second or locked position preventing upward movement of the upper latch pin actuator 16 and the substantially ridged elongated latch pin actuator bar or member 28 of the latch assembly 12 to lock the gate latch device 10 to prevent opening of the keeper assembly 14 relative to the latch assembly 12 to securely lock the gate (not shown) to the fence or other barrier (not shown).

As shown in FIG. 3, an upper actuator bar limit or stop 42 projects outwardly from the upper portion 26 of the substantially ridged elongated latch pin actuator bar or member 28 to selectively engage the lock assembly 34 or an upper stop member 43 mounted, formed or attached to the latch housing 22 to limit the upward movement of the upper latch pin assembly 16 and the lower latch pin assembly 18 of the latch assembly 12.

Figure 4:
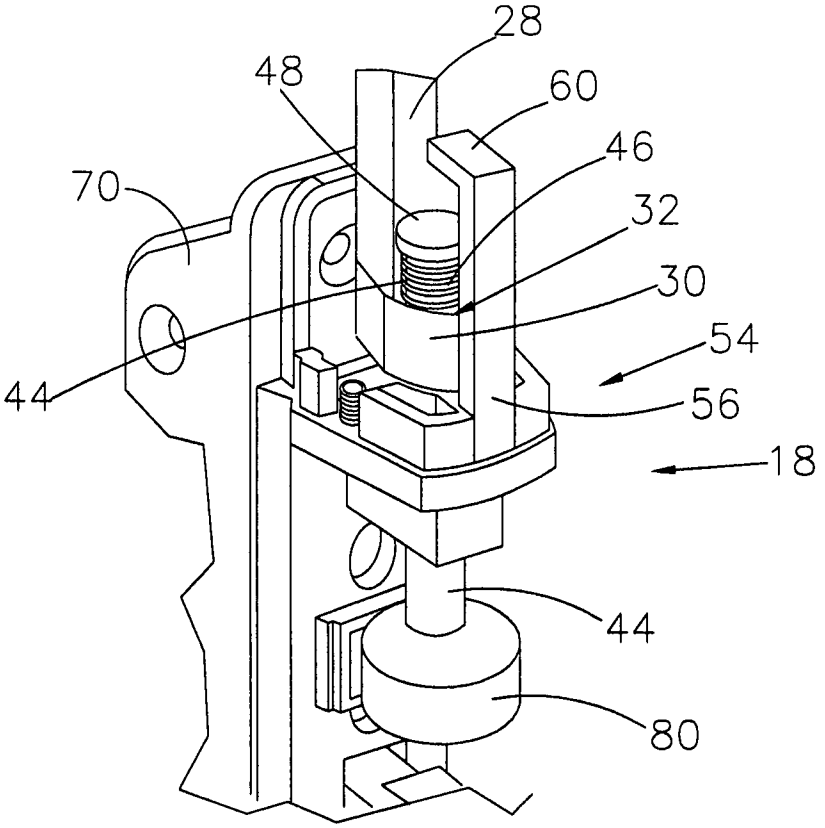
FIG. 4 is a partial perspective view of the latch pin assembly of the gate latch device of the present invention.
Figure 6:
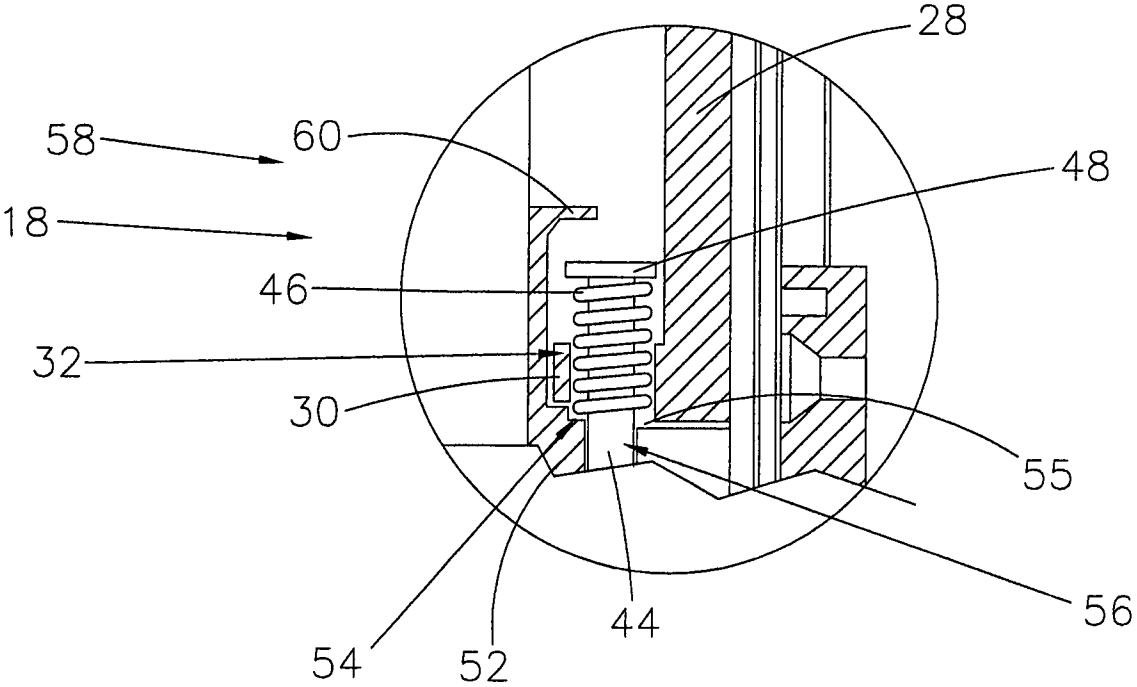
FIG. 6 is a partial cross-section side view of the lower latch pin assembly of the present invention.

As shown in FIGS. 3, 4 and 6, the lower latch pin assembly 18 comprises a lower latch pin or member 44 coupled to the lower portion of the substantially ridged elongated latch pin actuator bar or member 28 by the lower latch pin actuator support 30 and a bias or compression spring 46 disposed in surrounding relationship relative to the lower latch pin or member 44 to normally bias the lower latch pin or member 44 in an upper or unlatched position. An upper bias latch limit pin stop 48 to engage the upper portion of the bias or compression spring 46 is formed on the upper portion of the lower latch pin or member 44 respectively.

As shown in FIGS. 4 and 6, the lower latch pin assembly 18 further comprises a bias support 52 including a latch pin bias recess 54 having a bias support shoulder 55 formed therein to support the lower portion of the bias or compression spring 46, a latch pin channel 56 concentrically aligned with the latch pin bias recess 54 and the latch pin aperture 32 to receive at least a portion of the lower latch pin or member 44 therethrough and a latch pin limit generally indicated as 58 including a substantially horizontal upper limit member 60 disposed to engage the upper bias latch pin stop 48 of the lower latch pin or member 44 to limit upward movement of the lower latch pin or member 44 under the force of the bias or compression spring 46.

As shown in FIGS. 3 and 7, the keeper safety catch 20 comprises an upwardly projecting stop member 62 extending outwardly from the lower portion 64 of the latch assembly 12 and including a substantially vertical catch or stop surface 66 to selectively engage a portion of the keeper assembly 14 when the gate (not shown) is in the latched or closed position to prevent the keeper assembly 14 from becoming disengaged from the latch assembly 12 as described hereinafter.

As shown in FIGS. 2 and 3, the latch assembly 12 is attached to the post of the fence or other barrier (not shown) by an upper mounting bracket 68 and a lower mounting bracket 70.

As shown in FIGS. 1 through 5, the keeper assembly 14 comprises a latch base generally indicated as 71 attached to the gate (not shown) by a Mounting bracket 72 having a latch arm generally indicated as 74 extending outwardly therefrom. The latch base 70 and the latch arm 74 may be laterally adjustable relative to each other by an externally threaded member (not shown) that engages corresponding threads (not shown) formed on the latch base 70 and the latch arm 74.

As shown in FIGS. 3 and 5 the latch arm 74 of the keeper assembly 14 comprises a latch pin receptacle or latch pin recess 76 formed therein to receive the lower latch pin or member 44 when in the lower or latched position and a magnet recess 78 to retain a magnet 80 adjacent the latch pin recess 76.

The latch assembly 12 and the keeper assembly 14 are attached to the fence post (not shown) adjacent the fence opening (not shown) and the gate (not shown) respectively in proper vertical alignment relative to each other.

The lower latch pin or member 44 is normally biased in upper or unlocked position by the bias or compression spring 46 acting on or engaging the upper bias latch pin stop 48 to engage the substantially horizontal upper limit member 60 of the latch pin limit 58 and the bias support shoulder 55.

Since the magnet 80 is disposed adjacent the latch pin recess or latch pin receptacle 76, when the gate (not shown) is closed, the lower latch pin or member 44 and upper latch actuator assembly 16 are moved from the normally biased upper or unlatched position to the lower or latched position as the latch pin or member 44 is drawn or pulled into the latch pin recess or receptacle 76 against the force of the bias or compression spring 46 by the force of the magnet 80.

To release the keeper assembly 14 to open the gate (not shown), the upper latch pin actuator 16 and the substantially ridged elongated latch pin actuator bar or member 28 is pulled upwardly withdrawing the lower latch pin or member 44 coupled to the lower latch pin actuator support 30 from the latch pin receptacle or recess 78 as the bias or compression spring 46 moves the lower latch pin or member 44 to the upper or unlocked position when the lower latch pin or member 44 is no longer within the magnetic field of the magnet 80.

When the gate (not shown) is closed, the keeper assembly 14 is normally held in the closed position by the lower latch pin or member 44 of the lower latch pin assembly 18 disposed within the latch pin receptacle or latch pin recess 78 of the keeper assembly 14 by the magnet 80. In addition, the latch assembly 12 may be locked against vertical movement by the lock assembly 34.

However, as shown in FIGS. 3 and 7, if sufficient downward force is applied to the gate (not shown) such as a child attempting to swing on the gate, the latch assembly 12 and the keeper assembly 14 may become misaligned relative to each other in the horizontal plane as depicted by the phantom lines. To prevent the gate (not shown) from opening, the substantially vertical catch or stop surface 66 of the upwardly projecting stop member 62 of the keeper safety catch 20 engages the lower portion 84 of the rear wall 86 to limit the horizontal outward movement of the keeper assembly 14 relative to the latch assembly 12 to prevent the lower latch pin or member 44 from becoming dislodged from the latch pin recess 76 to maintain the gate (not shown) in the latched or closed position. The rear wall 86 is shorter than the front wall 88 forming a notch or opening 90 allowing the keeper assembly 16 to close without engaging the keeper safety catch 20 of the latch arm 74 of the keeper assembly 14.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. A gate latch device for use with a gate to secure the gate in a closed position attached to a fence or other barrier to close or block a portal formed therein, said gate latch device comprising:

a latch assembly including a lower portion mounted to the fence or other barrier adjacent the portal including an upper actuator pull member and a lower latch pin coupled to the upper actuator member and a keeper safety catch having a stop formed on said lower portion of said latch assembly and a keeper assembly including a magnet disposed adjacent a latch pin recess formed in said keeper assembly mounted to the gate such that when the gate is closed said magnet attracts said lower latch pin from a normally biased upper or unlatched position to a lower or latched position drawing said lower latch pin downward into said latch pin recess against the force of said bias to prevent the gate from opening and when the upper actuator pull member is pulled upwardly said lower latch pin is withdrawn from said latch pin recess allowing the gate to be opened and said stop of said keeper safety catch is disposed to engage said keeper assembly to maintain said lower latch pin disposed within said latch pin recess to prevent said latch pin from being dislodged from said latch pin recess when said upper actuator pull member in said lower position and said keeper assembly from becoming unlatched from said latch assembly.

2. The gate latch device of claim 1 wherein said keeper assembly comprises:

a latch arm having a notch or opening in a rear wall including a lower edge portion thereof and wherein said stop said keeper safety catch comprises an upwardly projecting stop member formed on a lower portion of said latch assembly to engage said lower edge portion of said rear wall when said keeper assembly and said latch assembly become vertically misaligned to maintain said lower latch pin within said latch pin recess.

3. The gate latch device of claim 2 wherein said latch assembly comprises:

an upper latch pin actuator assembly coupled to a lower latch pin assembly, and said upper latch pin actuator assembly comprises said upper actuator pull member coupled or attached to an elongated latch pin actuator bar or member having a lower latch pin support having a latch pin aperture formed therethrough formed on the lower portion thereof to couple said upper latch pin actuator assembly and said lower latch pin assembly together.

4. The gate latch device of claim 3 further including an upper actuator bar limit or stop projecting outwardly from an upper portion of said elongated latch pin actuator bar or member to selectively engage an upper stop member to limit the upward movement of said upper latch pin assembly and said lower latch pin assembly of said latch assembly.

5. The gate latch device of claim 3 wherein said lower latch pin assembly is coupled to a lower portion of said elongated latch pin actuator bar or member by said lower latch pin actuator support and a bias disposed in surrounding relationship relative to said lower latch pin or member to normally bias said lower latch pin or member in an upper or unlatched position.

6. The gate latch device of claim 5 further including an upper bias latch limit pin stop to selectively engage an upper portion of said bias formed on the upper portion of said lower latch pin or member.

7. The gate latch device of claim 6 wherein said lower latch pin assembly further comprises a bias support including a latch pin bias recess having a bias support shoulder formed therein to support a lower portion of said bias and a latch pin channel concentrically aligned with said latch pin bias recess and said latch pin aperture to receive at least a portion of said lower latch pin or member therethrough.

8. The gate latch device of claim 6 further a latch pin limit including an upper limit member disposed to engage said upper bias latch pin stop of said lower latch pin or member to limit upward movement of said lower latch pin or member under the force of said bias.

9. The gate latch device of claim 5 further a latch pin limit including an upper limit member disposed to engage said upper bias latch pin stop of said lower latch pin or member to limit upward movement of said lower latch pin or member under the force of said bias.

10. A gate latch device for use with a gate to secure the gate in a closed position attached to a fence or other barrier to close or block a portal formed therein, said gate latch device comprising:

a latch assembly including a lower latch pin mounted to the fence or other barrier adjacent the portal and a keeper assembly including a magnet disposed adjacent a latch pin recess mounted to the gate such that when the gate is closed said magnet attracts said lower latch pin from a normally biased upper or unlocked position to a lower or locked position drawing said lower latch pin downward into said latch pin recess against the force of said bias to prevent the gate from opening, said latch assembly comprises an upper latch pin actuator assembly coupled to a lower latch pin assembly, said upper latch pin actuator assembly comprises an upper actuator pull knob or member coupled or attached to an elongated latch pin actuator bar or member having a lower latch pin support having a latch pin aperture formed therethrough formed on the lower portion thereof to couple said upper latch pin actuator assembly and the lower latch pin assembly together, and an upper actuator bar limit or stop projecting outwardly from an upper portion of said elongated latch pin actuator bar or member to selectively engage an upper stop member extending inwardly into the interior of said latch housing to limit said upward movement of said upper latch pin assembly and said lower latch pin assembly of the latch assembly when said upper actuator pull knob or member is moved upwardly to release said lower latch pin from said lower or locked position.

11. The gate latch device of claim 10 wherein said lower latch pin assembly is coupled to a lower portion of said elongated latch pin actuator bar or member by said lower latch pin actuator support and a bias disposed in surrounding relationship relative to said lower latch pin or member to normally bias said lower latch pin or member in an upper or unlatched position.

12. A gate latch device of claim 11 further including an upper bias latch limit pin stop formed on said latch pin or member to selectively engage an upper limit member formed extending inwardly into the interior of said latch housing to limit the upward movement of said lower latch pin or member.

13. The gate latch device of claim 10 wherein said lower latch pin assembly further comprises a bias support including a latch pin bias recess having a bias support shoulder formed therein to support a lower portion of said bias and a latch pin channel concentrically aligned with said latch pin bias recess and said latch pin aperture to receive at least a portion of said lower latch pin or member therethrough.

14. The gate latch device of claim 10 further a latch pin limit including an upper limit member disposed to engage said upper bias latch pin stop of said lower latch pin or member to limit upward movement of said lower latch pin or member under the force of said bias.

15. The gate latch device of claim 10 further a latch pin limit including an upper limit member disposed to engage said upper bias latch pin stop of said lower latch pin or member to limit upward movement of said lower latch pin or member under the force of said bias.

16. The gate latch device of claim 10 further including a keeper safety catch disposed to selectively engage said keeper assembly to maintain said lower latch pin disposed within said latch pin recess to prevent said keeper assembly from becoming unlatched from said latch assembly when said latch assembly and said keeper assembly are misaligned vertically relative to each other thereby preventing the gate from opening.

17. The gate latch device of claim 16 wherein said keeper assembly comprises a latch arm having a notch or opening in a rear wall including a lower edge portion thereof and said keeper safety catch comprises an upwardly projecting stop member formed on a lower portion of said latch assembly to engage said lower edge portion of said rear wall when said keeper assembly and said latch assembly become vertically misaligned to maintain said lower latch pin within said latch pin recess.

* * * * *